United States Patent [19]

Dirk et al.

[11] 4,061,444

[45] Dec. 6, 1977

[54] COMPRESSOR MUFFLING ARRANGEMENT

[75] Inventors: William R. Dirk; Sidney A. Parker, both of Fort Worth, Tex.

[73] Assignee: Lennox Industries, Inc., Marshalltown, Iowa

[21] Appl. No.: 710,012

[22] Filed: July 30, 1976

[51] Int. Cl.[2] ..... F04B 21/00; F25B 41/00; F01N 7/18

[52] U.S. Cl. ..... 417/312; 181/265; 181/269

[58] Field of Search ..... 62/296; 417/312, 902, 417/313; 181/53, 69, 33 K, 40; 165/135

[56] References Cited

U.S. PATENT DOCUMENTS

| | | | |
|---|---|---|---|
| 2,823,850 | 2/1958 | Hintze | 417/312 |
| 3,073,515 | 1/1963 | Neubauer et al. | 417/902 |
| 3,187,996 | 6/1965 | Roelsgaard | 417/312 |
| 3,356,293 | 12/1967 | Butts | 417/312 |
| 3,443,632 | 5/1969 | Sauer | 165/135 |
| 3,664,769 | 5/1972 | Knudsen et al. | 417/312 |
| 3,968,854 | 7/1976 | Gordon et al. | 181/40 |

*Primary Examiner*—William L. Freeh

*Attorney, Agent, or Firm*—Allegretti, Newitt, Witcoff & McAndrews

[57] ABSTRACT

A refrigerant compressor including discharge gas muffling means formed within the outer housing means by first and second wall means which cooperate with the bottom of the outer housing means to provide first and second chambers. The first chamber is connected by an inlet port to the compression mechanism for receiving discharge gas therefrom and a discharge port is provided from the second chamber to communicate the discharge gas to the discharge line of a refrigeration system. Divider walls within the first and second chambers are provided with restricted openings so as to provide restriction passages and expansion chamber muffling regions within the first and second chambers to effectively muffle noises emanating from the discharge gas passing from the compression mechanism to the discharge line outside of the compressor. In a modification, a third chamber may be added between the oil sump and discharge gas muffling chambers and a vacuum is pulled in the third chamber to materially reduce heat transfer much like a vacuum bottle does. A lubricant sump may be provided within the outer housing means above the second wall so as to reduce vibration and the emanation of noise from the discharge gas muffling means.

7 Claims, 5 Drawing Figures

COMPRESSOR MUFFLING ARRANGEMENT

BACKGROUND OF THE INVENTION

The present invention relates to a refrigerant compressor provided with improved discharge gas muffling means formed within the outer housing of such compressor. More particularly, the present invention relates to an improved refrigeration compressor which incorporates discharge gas muffling means comprising separate wall means cooperating with the outer housing to form first and second chambers and a plurality of divider walls within the chambers for providing a plurality of muffling regions within each chamber, the muffling regions being connected in series so as to effectively muffle the discharge gas passing from an inlet to the discharge gas muffling means to an outlet communicating with the discharge gas line of the refrigeration system.

One known method of muffling discharge gas in a refrigeration system was to provide a discharge gas muffler in the discharge line exterior of the refrigerant compressor. Such installation was not entirely satisfactory as it was subject to tampering and damage in the field.

It has also been proposed to provide a cast iron discharge gas muffling means bolted to a compression mechanism. Such cast iron muffling device is relatively expensive. Further, cast iron is brittle and could be dangerous to life if a rupture should occur.

Further, it has been suggested that a discharge gas muffler made from a sheet metal housing be connected to the inlet to one end of the discharge line within the refrigerant compressor and at the outlet to the discharge gas line communicating with the refrigeration system. Such arrangement was not found to be entirely satisfactory as it resulted, on occasion, in excess vibration and inadequate muffling of the noise. Since space was limited between the compression mechanism and the outer housing, placement of a properly sized muffler within the compressor was sometimes a problem.

An object of the present invention is to provide an improved refrigerant compressor with discharge gas muffling means that are formed within the outer housing and incorporate wall means within the outer housing which cooperate with the outer housing to define the discharge gas muffling means.

Another object of the present invention is to provide a discharge gas muffling means entirely within a refrigerant compressor, which muffling means is substantially coextensive with the bottom of the outer housing means and is formed within the outer housing means such that a substantial volume may be occupied by the discharge gas muffling means to help effectively muffle the discharge gas noises.

Another object of the present invention is to provide an improved discharge gas muffling means entirely within the outer housing of a refrigerant compressor in such fashion that the oil sump may be formed on wall means defining the discharge gas muffling means so as to help reduce possible noise and vibration emanating from the discharge gas muffling means.

Yet another object of the present invention is to provide a refrigerant compressor with a heat insulating vacuum chamber between the oil sump and the discharge gas muffling means within the compressor outer casing.

Other objects and advantages of the present invention will become more apparent hereinafter.

BRIEF DESCRIPTION OF THE DRAWING

There is shown in the attached drawing presently preferred embodiments of the present invention wherein.

DETAILED DESCRIPTION OF THE PRESENT INVENTION

Figure 1:
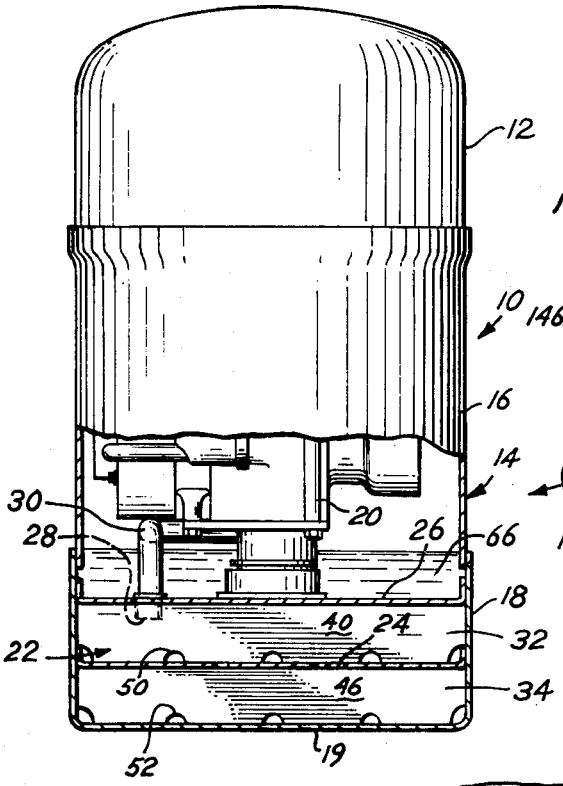
FIG. 1 is an elevation view, with parts broken away, of a refrigerant compressor incorporating the discharge gas muffling means embodying principles of the present invention.
Figure 2:
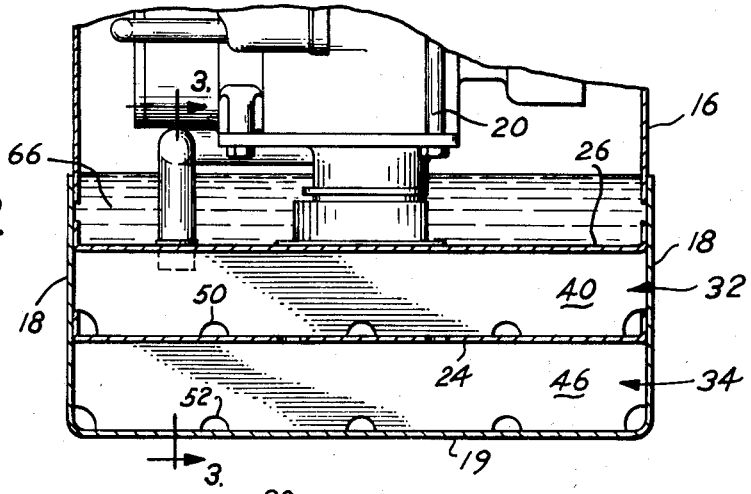
FIG. 2 is an enlarged detail view of the discharge gas muffling means of FIG. 1.
Figure 3:
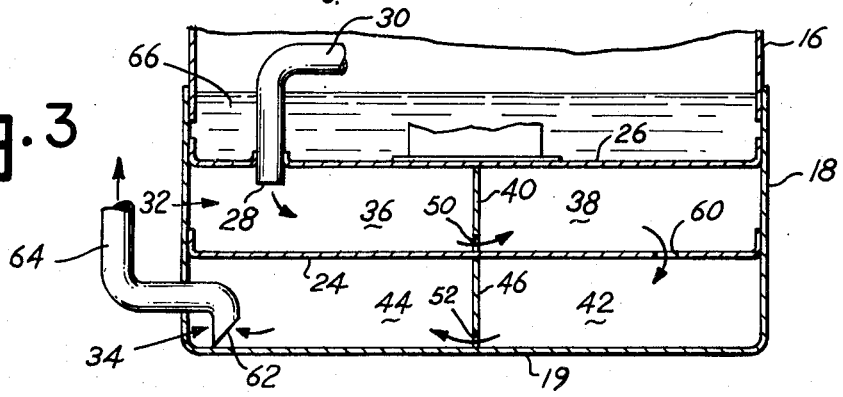
FIG. 3 is a detailed view taken generally along the line 3—3 of FIG. 2 and better illustrating the discharge gas muffling means of the present invention.

Referring to FIGS. 1, 2 and 3, there is illustrated a refrigerant compressor 10 which embodies one embodiment of discharge gas muffling means incorporating principles of the present invention. The refrigerant compressor 10 comprises an outer housing including an upper shell 12, that is hermetically bonded to lower shell means 14, as for example, by welding. The lower shell means 14 may comprise a generally annular portion 16 and a cup-shaped portion 18 which includes side walls and a bottom 19. The outer housing is made from sheet metal parts suitably formed and joined together.

Mounted within the refrigerant compressor 10 is a compression mechanism 20 for receiving suction gas from a suction line in a refrigeration system, compressing same, and then forwarding the compressed gas to the refrigeration system.

The present invention comprises a discharge gas muffling means 22 housed entirely within the refrigerant compressor 10. In addition to the bottom wall 19 and the side walls 18 of the lower shell means 14 of the outer housing, the discharge gas muffler 22 includes a first wall means 24 and a second wall means 26. The first and second wall means 24 and 26 are preferably made from sheet metal, for example, steel. The walls 24 and 26 are generally planar member having an annular rim sealingly secured to the upright walls 18 of the lower shell means 14, by suitable means, for example, welding. The second wall 26 is imperforate except for the inlet port 28 which communicates the compression mechanism 20 with the discharge gas muffling means 22 via the discharge gas line 30. The first wall is imperforate except for the port 60 that communicates the chambers 32 and 34.

Formed within the discharge gas muffler 22 are a first upper chamber 32 and a second lower chamber 34. The first chamber 32 is divided into a first muffling region 36 and a second muffling region by divider wall 40 and the second chamber 34 is divided into a first muffling region 42 and a second muffling region 44 by a divider wall 46. The divider wall 40 is adapted to be connected at its upper and lower edges to the first wall 24 and the second wall 26 within the outer housing of the compressor 10. Similarly, the divider wall 46 is adapted to be connected along its upper and lower edges, respectively, to the bottom wall 19 of the lower shell means 14 and the first wall 24. Restricted opening means 50 are provided in the wall 40 for communicating the muffling regions 36 and 38. Similarly, restricted openings 52 are provided in the wall 46 in order to communicate the muffling regions 42 and 44 in the chamber 34. The muffling region 38 in the chamber 32 communicates with the muffling region 42 in the chamber 34 through the restricted opening 60 in the first wall 24. The discharge gas may pass from the chamber 34 through the discharge opening or port 62 at the inlet to the discharge line 64 from the compressor 10 into the discharge line 64.

In operation, compressed discharge gas from the compression mechanism 20 will pass through the discharge line 30 and through the inlet 28 into the muffling region 36 of the chamber 32. The discharge gas will be expanded in the volume of the muffling region 36. The gas will then pass through the restricted opening 50 in the wall 40 into the muffling region 38 where it will again be expanded. From the muffling region 38 of chamber 32 the gas will pass through the restricted opening 60 in the wall means 24 into the muffling region 42 of the chamber 34. In the muffling region 42 the gases will again be expanded after passing through the restriction 60. From muffling region 42 the gas will pass through the restricted openings 52 in the divider wall 46 into the muffling region 44 where the gases again expanded. The gases then enter the discharge port 62 for passage into the discharge line 64 to the refrigeration system. Thus, discharge gas entering the discharge gas muffler 22 will pass serially through restrictions and expansion chambers and will be alternately restricted and expanded to provide an efficient muffling of the discharge gas. It is also noted that the oil sump 66 within the compressor 10 is formed above the wall 26 which forms a part of the discharge gas muffler 22. This construction has a damping effect and tends to deaden vibrations emanating from the discharge gas muffler and helps to provide a quiet discharge gas muffler.

With reference to FIGS. 1, 2 and 3 it is seen that there has been provided a discharge gas muffler 22 having four muffling regions formed therein. The muffler is relatively large in that it has a diameter substantially coextensive with the diameter of the lower shell means of the outer housing of the compressor 10.

Figure 4:
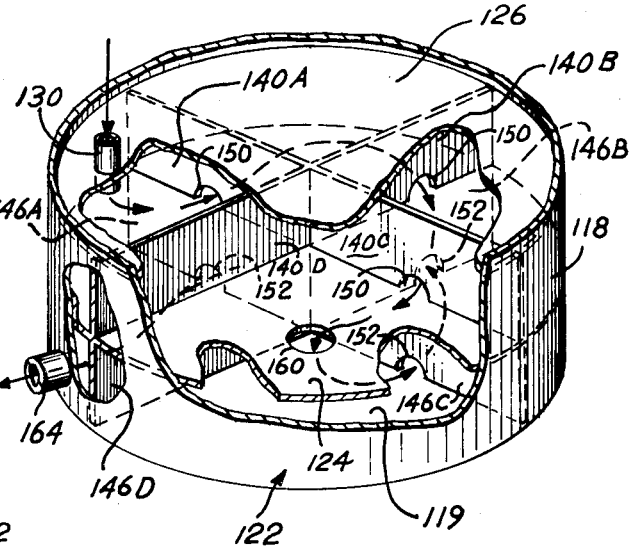
FIG. 4 is a perspective view illustrating a portion of a refrigerant compressor incorporating a modified discharge gas muffling means having eight muffling regions therewithin.

Turning now to FIG. 4, there is illustrated a modification of the discharge gas muffler of the present invention which embodies twice the number of muffling regions. For convenience, the like parts of the modification of FIG. 4 will be identified with a prefix "1". The discharge gas muffler 122 includes a casing or housing portion having an upright wall 118 and a bottom 119. The discharge gas muffler 122 includes wall means 126 and 124 which are disposed generally parallel to the base 119 and are connected integrally to the upright wall 118, for example, by welding. Preferably, the discharge gas muffler is made from sheet metal components suitably bonded together, as for example, copper brazing, to form the separate chambers and muffling regions therein. The construction is sturdy and strong. The first chamber 132 is divided into four muffling regions by means of the divider walls 140A, 140B, 140C and 140D. Likewise, the second chamber 134 is divided into four muffling regions by means of the divider walls 146A, 146B, 146C and 146D.

In use, the discharge gas passing from the compression mechanism will flow through the line 130 into the muffling regions defined between the walls 140A, 140D, 118, 124 and 126. The discharge gas expands in this muffling region and then is contracted as it flows through the restricted opening 150 into the muffling region defined between the walls 140A, 140B, 118, 124 and 126. The gas expands and then contracts as it passes through the restricted opening 150 in the wall 140B into the muffling region defined between walls 118, 140B, 140C, 124 and 126. The discharge gas passing through the restricted opening 150 in the wall 140C expands within the muffling region defined between the walls 118, 140C, 140D, 124 and 126. The wall 140D is imperforate and thus, the discharge gas which flowed serially through the four muffling regions within the chamber 132 passes through the restricted opening 160 into the muffling region defined between the walls 118, 119, 124, 146C, 146D. The discharge gas passes serially through the four muffling chambers or muffling regions in the chamber 134 via openings 152 in walls 146C, 146B and 146A, respectively, and passes from the discharge port 162 and the discharge line 164 to the refrigeration system.

There has been provided by the embodiments of FIGS. 1–4 an improved discharge gas muffler that is incorporated within the outer housing of a compressor and forms a part thereof. The discharge gas muffler 22 or 122 is relatively easily formed and can be made relatively large in an expedient manner. By virtue of positioning the oil sump of the compressor on the upper wall 26 or 126 of the discharge gas muffler, the muffling capabilities of the discharge gas muffler can be enhanced.

Figure 5:
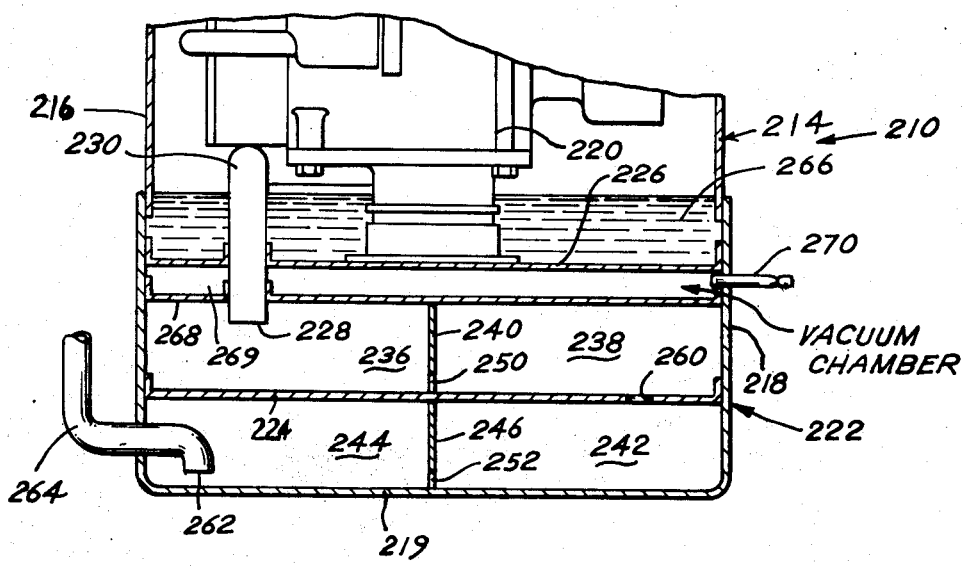
FIG. 5 is an elevation view, with parts broken away, of a modified refrigerant compressor having a vacuum chamber between the oil sump and the discharge gas muffling means within the compressor outer casing.

FIG. 5 discloses a modification of the refrigerant compressor of FIGS. 1–3 which incorporates a vacuum chamber between the oil sump and the discharge gas muffling means to materially reduce heat transfer between oil in the sump and relatively hot discharge gas in the discharge gas muffling means. The embodiment of FIG. 5 is similar in many respects to the embodiment of FIG. 1–3 and emphasis will be placed upon the differences. Compressor 210 includes an upper shell (not shown) hermetically joined to a lower shell means 214. A discharge gas muffler means, 222 is integrally joined to lower shell means 214. The discharge gas muffler means 222 is intended to be constructed and function in the same manner as the discharge gas muffler means shown in FIG. 3. Wall 226 is spaced from wall 268 to form a vacuum chamber 269 between the oil sump 266 and the discharge gas muffler 222. A process tube 270 communicates with the vacuum chamber 269 and after the parts are assembled a vacuum is drawn in the chamber 266. Then the process tube 270 may be sealed proximate the exterior of the outer casing and suitably bent over or capped so as to avoid an undesirable projection.

While we have shown presently preferred embodiments of the present invention, it will be apparent to those skilled in the art that they may be otherwise embodied within the scope of the claims that follow

We claim:

1. In a refrigerant compressor including outer housing means, compression mechanism within the outer housing means, and an oil sump within the outer housing means, the improvement comprising discharge gas muffling means formed within the outer housing means, such discharge gas muffling means comprising a part of the outer housing means, first wall means, and second wall means cooperating therewith to provide first and second chambers in the discharge gas muffling means, an inlet port in the second wall means for communicating the compression mechanism with the first chamber for receiving discharge gas from the compression mechanism, said first chamber communicating with said second chamber, and a discharge port from said second chamber adapted to communicate to a discharge line, and divider wall means in said first chamber and said second chamber having restricted openings therein for providing a plurality of muffling regions in said first and second chambers, a restricted opening in said first wall means communicating one muffling region in the second chamber with a muffling region in the first chamber, the oil sump defined within the compressor by the outer housing means and the second wall means, whereby discharge gas will pass from the inlet port through a plurality of restricted openings and expansion chamber muffling regions and will be discharged from the discharge port.

2. A refrigerant compressor as in claim 1 including a vacuum chamber defined within the compressor between the oil sump and the discharge gas muffling means to reduce heat transfer between the oil in the oil sump and the relatively hot discharge gas in the discharge gas muffling means.

3. A refrigerant compressor as in claim 1 wherein the first and second wall means are substantially flat and are disposed substantially parallel to one another within the outer housing means.

4. A refrigerant compressor as in claim 3 wherein the first and second wall means are substantially parallel to the bottom wall of the outer housing means.

5. A refrigerant compressor as in claim 1 wherein there are at least four divider walls in the first chamber for dividing same into four muffling regions, the muffling regions connected in series by restricted openings in each divider wall.

6. A refrigerant compressor as in claim 5 wherein there are at least four divider walls in the second chamber for dividing same into four muffling regions, the muffling regions connected in series by restricted openings in each divider wall.

7. A refrigerant compressor as in claim 6 wherein the discharge gas muffling means is made from steel sheet.

* * * * *